US007686067B2

(12) United States Patent
Harada et al.

(10) Patent No.: US 7,686,067 B2
(45) Date of Patent: Mar. 30, 2010

(54) DIE CASTING MACHINE

(75) Inventors: Hideaki Harada, Kariya (JP); Hiromi Takagi, Nagoya (JP); Naohiko Tsuzuki, Akashi (JP)

(73) Assignees: Denso Corporation, Kariya (JP); Toyo Machinery & Metal Co., Ltd., Akashi-shi (JP)

( * ) Notice: Subject to any disclaimer, the term of this patent is extended or adjusted under 35 U.S.C. 154(b) by 0 days.

(21) Appl. No.: 11/798,588

(22) Filed: May 15, 2007

(65) Prior Publication Data

US 2007/0267166 A1 Nov. 22, 2007

(30) Foreign Application Priority Data

May 18, 2006 (JP) ..... 2006-139467

(51) Int. Cl.
*B22D 17/08* (2006.01)

(52) U.S. Cl. ..... 164/312; 164/314

(58) Field of Classification Search ..... 164/312, 164/314, 113

See application file for complete search history.

(56) References Cited

U.S. PATENT DOCUMENTS 6,629,558 B2 * 10/2003 Tsuji ..... 164/314
7,004,224 B2 2/2006 Tsuzuki et al.
2004/0099400 A1 * 5/2004 Tsuzuki et al. ..... 164/312

FOREIGN PATENT DOCUMENTS

| | | |
|---|---|---|
| JP | A-02-038020 | 2/1990 |
| JP | A-09-277339 | 10/1997 |
| JP | A-10-52747 | 2/1998 |
| JP | A-10-119102 | 5/1998 |
| JP | A-63-154253 | 6/1998 |
| JP | A-10-249510 | 9/1998 |
| JP | A-2000-033472 | 2/2000 |
| JP | A-2004-174502 | 6/2004 |

OTHER PUBLICATIONS

Translation of Japanese Office Action issued Nov. 4, 2009 in JP 2006-139467.

* cited by examiner

*Primary Examiner*—Kevin P Kerns
(74) *Attorney, Agent, or Firm*—Oliff & Berridge, PLC

(57) ABSTRACT

A die casting machine 100 to fill by injecting molten metal into a die cavity 24 includes a variable displacement pump 16 driven by a servo motor 17 for discharging hydraulic fluid from a hydraulic fluid tank 40, an injection cylinder 11 with a slidable piston 12 assembled therein, hydraulic fluid pipes a and c for supplying hydraulic fluid discharged by the variable displacement pump 16 to the injection cylinder 11, hydraulic fluid pipes d, e1, g and a logic valve 14 connected to hydraulic fluid pipe c for supplying hydraulic fluid ejected from the injection cylinder 11 to hydraulic fluid pipe c with the piston 12 slid by the hydraulic fluid supplied to the injection cylinder 11.

6 Claims, 2 Drawing Sheets

DIE CASTING MACHINE

BACKGROUND OF THE INVENTION

1. Field of the Invention

This invention relates to a die casting machine to fabricate high-strength products by filling molten metal into a die cavity by injection and applying a predetermined pressure to the molten metal.

2. Description of the Related Art

A die casting machine capable of high-speed injection without using an accumulator is disclosed in Japanese Unexamined Patent Publication No. 2004-174502.

In the die casting machine disclosed in Japanese Unexamined Patent Publication No. 2004-174502, molten metal is filled by injection into a die cavity using a single two-way hydraulic pump in such a manner that the rotational speed of the drive motor of the two-way hydraulic pump is controlled at the time of filling the molten metal by injection and the torque of the drive motor of the two-way hydraulic pump is controlled to maintain pressure.

SUMMARY OF THE INVENTION

The injection speed of the die casting machine disclosed in Japanese Unexamined Patent Publication No. 2004-174502, varies depending on the motor performance and the capacity of the two-way hydraulic pump. In this die casting machine, the realization of high-speed injection, i.e. the realization of the high-speed drive (1 m/s or more in moving speed) of the cylinder requires the use of an expensive device configuration such as a large-output motor (servo motor) with a large-capacity pump or two or more motors and pumps.

This invention has been achieved in view of this problem, and the object thereof is to provide a die casting machine wherein a highly accurate high-speed injection is made possible without using an expensive device configuration.

In order to achieve the object described above, according to a first aspect of the invention, there is provided a die casting machine for injecting molten metal into a die cavity by injection, comprising a pump driven by a drive motor for discharging the hydraulic fluid from a hydraulic fluid tank, a piston for filling the molten metal by injection into the cavity, an injection cylinder having the piston assembled therein in an operable state and having the internal space thereof divided into two hydraulic chambers by the piston, a hydraulic fluid supply path for supplying the hydraulic fluid discharged by the pump into one of the hydraulic chambers, and an ejected fluid supply path connected to the hydraulic fluid supply path for supplying the hydraulic fluid ejected from the other one of the hydraulic chambers of the injection cylinder to the hydraulic fluid supply path by the piston with the hydraulic fluid supplied to the injection cylinder.

In addition to the hydraulic fluid discharged by the pump, the projection of the piston supplies the hydraulic fluid ejected from the other one of the hydraulic chambers of the injection cylinder to one of the hydraulic chambers of the injection cylinder thereby increasing the amount of hydraulic fluid supplied to the injection cylinder. With the increase in the amount of the hydraulic fluid supplied to the injection cylinder, piston moving speed is also increased to achieve a higher injection speed. Therefore, high-speed injection is made possible without using an expensive large-output drive motor or large-capacity pump.

According to a second aspect of the invention, there is provided a die casting machine, wherein the pump may be a variable displacement pump. The employment of the variable displacement pump makes it possible to switch to a low pressure and large capacity in the case where high speed is required for filling the molten metal by injection, and to a high pressure and small capacity in the case where high pressure is required for a dead head after filling the molten metal. Unlike the high-pressure large-capacity pump, a large-output motor is not required as a drive motor.

According to a third aspect of the invention, there is provided a die casting machine, wherein a servo motor may be used as the drive motor. The use of the servo motor makes it possible to easily control injection speed by controlling the rotational speed of the servo motor and thus the pump discharge amount, and to control the injection pressure by controlling the rotary torque and thus the pump discharge pressure.

According to a fourth aspect of the invention, there is provided a die casting machine further comprising a restriction mechanism in the ejected fluid supply path for generating pressure in the hydraulic fluid.

Normally, the die cavity is configured in such a manner that the gate constituting the port to fill the molten metal into the die cavity has a small cross-sectional area. When filling the molten metal in the die cavity, the resistance of the molten metal is maximized and injection speed (piston moving speed) may be reduced at the gate position.

In this invention, however, the provision of the restriction mechanism can keep the pressure at a certain level even during high speed piston movement. The provision of the restriction mechanism, requires less energy to increase the pressure required to overcome the reaction (gate resistance) of filling the molten metal. Thus, speed reduction is minimized and a highly accurate injection is made possible.

According to a fifth aspect of the invention, there is provided a die casting machine comprising hydraulic fluid paths, which include a hydraulic fluid tank, pump, injection cylinder, hydraulic fluid supply path, ejected fluid supply path, and a directional control valve for switching the hydraulic fluid paths in accordance with the operation of the injection cylinder, and a control unit for controlling the directional control valve, pump and drive motor.

In fabricating a die-cast product on a die casting machine, a plurality of steps (low-speed injection, high-speed injection, high-pressure holding and injection/retreatment) are required, and in accordance with each step, a plurality of hydraulic fluid paths may be required. Therefore, the die casting machine, preferably includes a plurality of directional control valves for switching the hydraulic fluid paths, and a control unit for controlling the plurality of the directional control valves, pump and drive motor.

According to a sixth aspect of the invention, there is provided a die casting machine, wherein the control unit controls the timing to switch the injection step for injecting the molten metal into the die cavity, and the high pressure holding step for preventing the die-cast product from developing a blowhole after the injection step, and wherein the switch timing is preferably controlled based on at least one of a position signal indicating the piston position in the injection cylinder, a pressure signal indicating the fluid pressure in the injection cylinder, a torque signal indicating the torque of the drive motor and the pulse signal of the drive motor.

The present invention may be more fully understood from the description of the preferred embodiments of the invention, as set forth below, together with the accompanying drawings.

DESCRIPTION OF THE PREFERRED EMBODIMENTS

Figure 1:
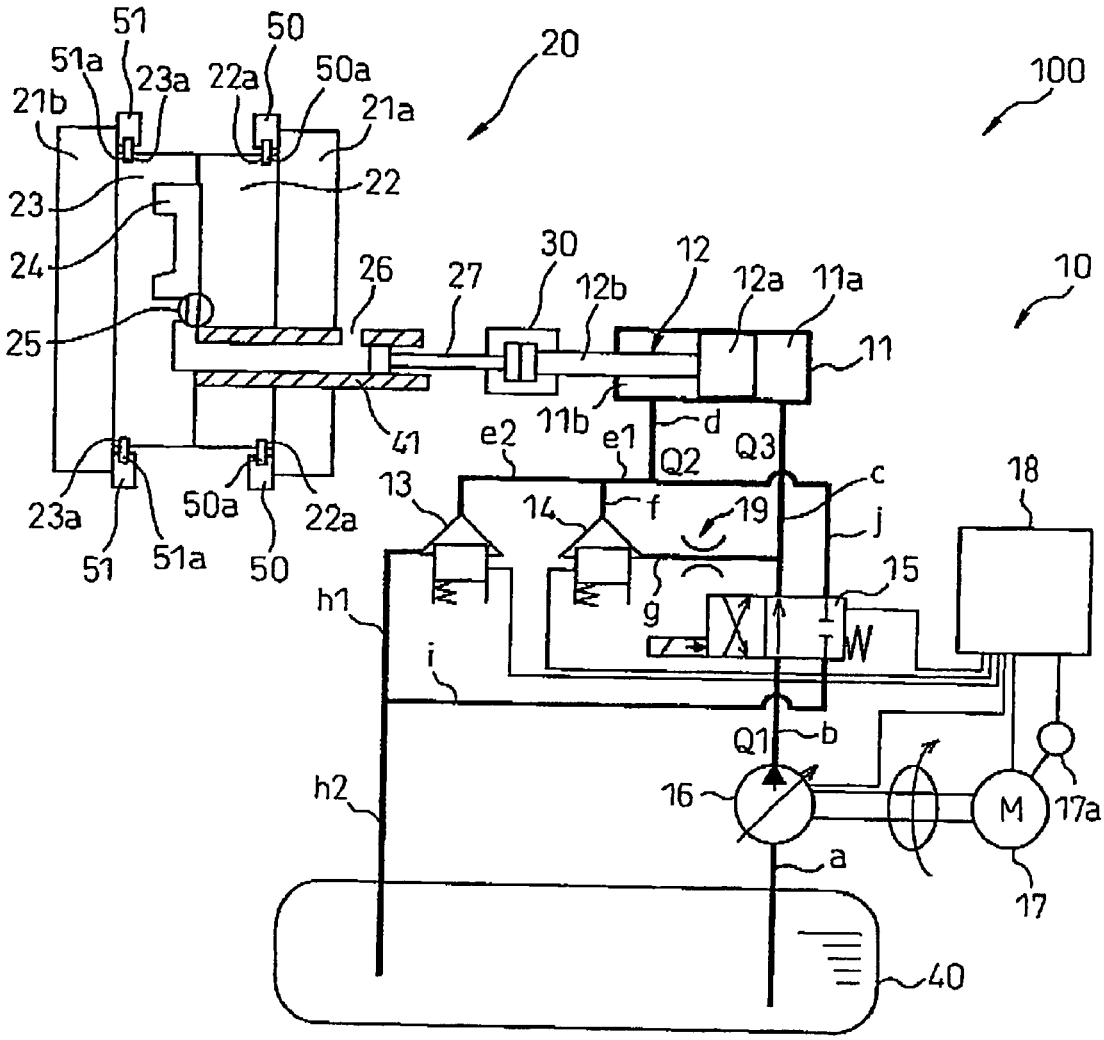
FIG. 1 is a diagram showing a general configuration of a die casting machine according to an embodiment of the invention.
Figure 2B:
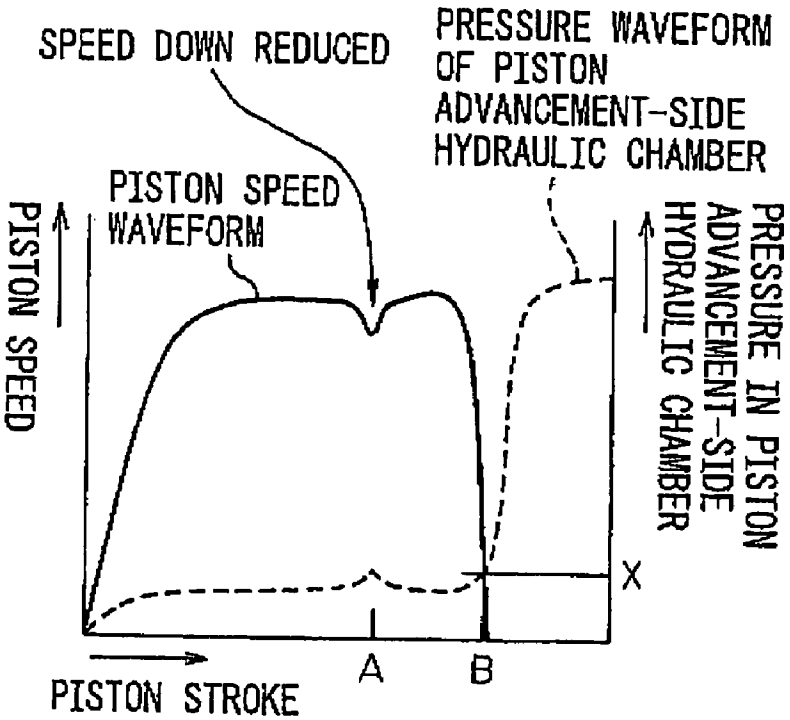
FIG. 2B is a graph showing the piston speed and the hydraulic chamber pressure in the presence of the restriction mechanism.
Figure 2A:
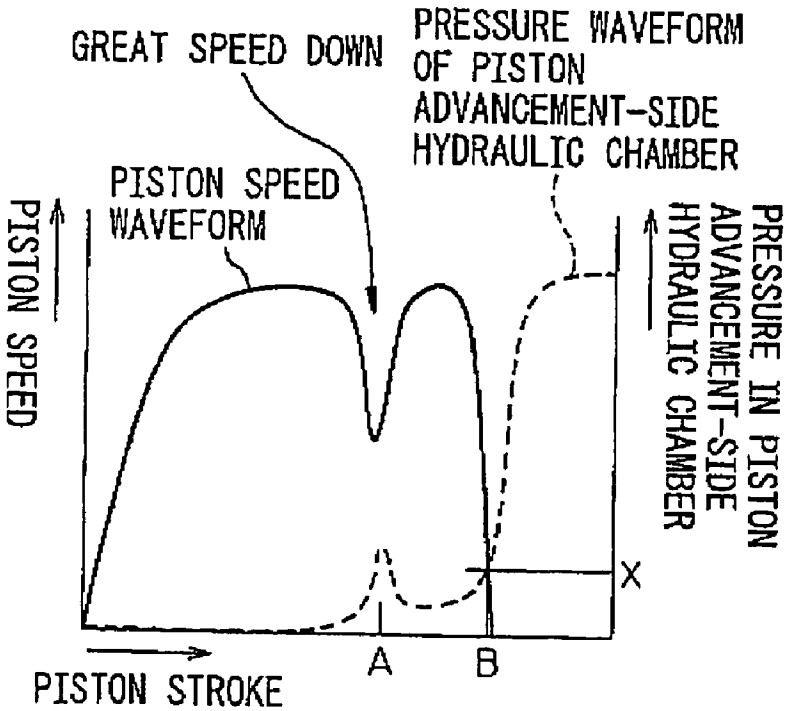
FIG. 2A is a graph showing the piston speed and the hydraulic chamber pressure in the absence of the restriction mechanism of the die casting machine according to an embodiment of the invention.

An embodiment of the invention is explained below with reference to the drawings. FIG. 1 is a diagram showing a general configuration of a die casting machine according to an embodiment of the invention. FIGS. 2A and 2B are graphs for explaining the effects of the restriction mechanism of the die casting machine according to an embodiment of the invention, in which FIG. 2A shows the absence of the restriction mechanism and FIG. 2B the presence of the restriction mechanism.

As shown in FIG. 1, the die casting machine 100 according to this embodiment includes an injection unit 10, a die unit 20 and a coupling 30 for connecting the injection unit 10 and the die unit 20.

The injection unit 10 includes an injection cylinder 11, a piston 12 (having a piston head 12*a* and a piston rod 12*b*), a logic valve 13, a logic valve 14, a switch valve 15, a variable displacement pump 16, a servo motor 17, a control unit 18, a restriction mechanism 19 and hydraulic fluid pipes a to j.

The injection cylinder 11 is assembled with the piston 12 in a movable (slidable) state, and connected to hydraulic fluid pipes c and d with hydraulic fluid flowing therein to move the piston 12. Also, the injection cylinder 11 comprises a piston advancement-side hydraulic chamber 11*a* and a piston retraction-side hydraulic chamber 11*b* together with a part of the piston rod 12*b* and piston head 12*a* arranged in the injection cylinder 11.

The piston advancement-side hydraulic chamber 11*a*, connected to the hydraulic fluid pipe c, constitutes a hydraulic chamber on the side of the piston head 12*a* of the injection cylinder 11 far from the piston rod 12*b*. The piston retraction-side hydraulic chamber 11*b*, connected with the hydraulic fluid pipe d, constitutes a hydraulic chamber on the side of the piston head 12*a* of the injection cylinder 11 near the piston rod 12*b*. Specifically, the piston advancement-side hydraulic chamber 11*a* is supplied with hydraulic fluid through the hydraulic fluid pipe c from the variable displacement pump 16 in the injection step for injecting the molten metal into the die cavity 24, while the piston retraction-side hydraulic chamber 11*b* discharges hydraulic fluid to the hydraulic fluid tank 40 through the hydraulic fluid pipe d at the time of injecting the molten metal into the die cavity 24. The interior of the hydraulic fluid tank 40 is maintained at substantially the same pressure as atmospheric pressure.

The on-off operation of the logic valves 13, 14 is controlled by the control unit 18 to switch the hydraulic fluid paths in accordance with the injection step for injecting the molten metal into the die cavity 24, the high pressure holding step for preventing the die-cast product from developing a blowhole and the step of retracting the plunger rod 27. The logic valves 13, 14 are not specifically limited and may be any valve mechanism capable of switching the hydraulic fluid paths.

The directional control valve 15 is also controlled by the control unit 18 to switch the hydraulic fluid paths in accordance with the injection step for injecting the molten metal into the die cavity 24, the high pressure holding step for preventing the die-cast product from developing a blowhole and the step of retracting the plunger rod 27. Specifically, the directional control valve 15 is a valve mechanism for switching between a state in which the hydraulic fluid pipes b and c are connected by the control unit 18 thereby forming a first hydraulic fluid path of the hydraulic fluid paths while at the same time separating the hydraulic fluid pipes i and j thereby interrupting a second hydraulic fluid path of the hydraulic fluid paths and a state in which the hydraulic fluid pipes b and j are connected thereby to form a third hydraulic fluid path of the hydraulic fluid paths while at the same time connecting the hydraulic fluid pipes c and i thereby forming a fourth hydraulic fluid path of the hydraulic fluid paths. The directional control valve 15 is not limited specifically and may be any valve mechanism capable of switching the hydraulic fluid paths.

The hydraulic fluid pipe a is connected to the hydraulic fluid tank 40 and the variable displacement pump 16, the hydraulic fluid pipe b to the variable displacement pump 16 and the directional control valve 15, and the hydraulic fluid pipe c to the directional control valve 15 and the injection cylinder 11 (piston advancement-side hydraulic chamber 11*a*).

The hydraulic fluid pipe d connected to the injection cylinder 11 (piston retraction-side hydraulic chamber 11*b*) is connected to the logic valve 14 through hydraulic fluid pipes e1 and f on the one hand and to the logic valve 13 through the hydraulic fluid pipes e1 and e2 on the other hand. Further, the hydraulic fluid pipe d connected to the injection cylinder 11 (piston retraction-side hydraulic chamber 11*b*) is connected to the directional control valve 15 through hydraulic fluid pipe j.

The hydraulic fluid pipe h1 connected to the logic valve 13 is connected to the hydraulic fluid tank 40 through the hydraulic fluid pipe h2 and to the directional control valve 15 through the hydraulic fluid pipe i at the same time. Also, the hydraulic fluid pipe g connected to the logic valve 14 is connected to the hydraulic fluid pipe c, which in turn is connected to the directional control valve 15 and the injection cylinder 11 (piston advancement-side hydraulic chamber 11*a*).

The variable displacement pump 16, which is adapted to be driven by the servo motor 17, sucks up and discharges the hydraulic fluid from the hydraulic fluid tank 40. This embodiment uses a variable displacement pump 16 capable of switching the capacity by the control unit 18. Nevertheless, a pump incapable of switching the capacity may alternatively be used with equal effect. The servo motor 17 includes a rotation angle sensor 17*a* for detecting the rotation angle of the motor and outputs a pulse signal corresponding to the detected rotation angle to the control unit 18. This pulse signal corresponds to the position signal indicating the position of the piston 12. In this way, the control unit 18, based on this pulse signal, rotationally drives the servo motor 17 and activates the logic valves 13, 14, the directional control valve 15 and the variable displacement pump 16 at the same time. The control unit 18, based on the rotation angle detected by the rotation angle sensor 17*a*, for example, controls (determines) the switch timing between the injection step and the high pressure holding step described later. Specifically, the control unit 18 determines, during the execution of the injection step, whether the piston 12 has reached a predetermined position (point B shown in FIG. 2) based on the rotation angle detected by the rotation angle sensor 17*a*. Upon determination that the piston 12 has reached the predetermined position (point B shown in FIG. 2), the control unit 18 ends the injection step and executes the high pressure holding step.

The control unit 18, mainly configured of a microcomputer, includes a memory such as ROM, RAM or EEPROM and an interface circuit or a data transfer bus line. The control unit 18, in accordance with a pulse signal and the program stored in ROM, RAM or EEPROM, controls the logic valves 13, 14, the directional control valve 15, the variable displacement pump 16 and the servo motor 17.

The rotation angle sensor 17*a* may be replaced with at least one of a position sensor for detecting the position of the piston 12 in the injection cylinder 11, a pressure sensor for detecting the fluid pressure in the injection cylinder 11 and a torque sensor for detecting the torque of the servo motor 17. Specifically, the timing of switching between the injection step and the high pressure holding step can also be controlled by the position signal indicating the position of the piston 12 in the injection cylinder 11 output by the position sensor, the pressure signal indicating the fluid pressure in the injection cylinder 11 output by the pressure sensor or the torque signal indicating the torque of the servo motor 17 output by the torque sensor. In this case, the control unit 18 rotationally drives the servo motor 17, while at the same time controlling the logic valves 13, 14, the directional control valve 15 and the variable displacement pump 16, based on the position signal, the pressure signal and the torque signal. Therefore, the rotation angle sensor 17*a*, can be replaced appropriately with the position sensor, the pressure sensor or the torque sensor.

The hydraulic fluid pipes a to j, through which the hydraulic fluid flows, together with the injection cylinder 11, the logic valves 13, 14, the directional control valve 15, the variable displacement pump 16 and the hydraulic fluid tank 40, make up hydraulic fluid paths. The hydraulic fluid pipes b, c and the directional control valve 15 correspond to the hydraulic fluid supply path according to the invention. The hydraulic fluid pipes d, e1, f, g and the logic valve 14, correspond to the ejected fluid supply path according to the invention.

Molten metal used in the die casting machine according to this embodiment is solidified within such a short period of time that a high injection speed (at least the moving speed 1 m/s of the piston 12) is required. Therefore, the ejected fluid supply path includes hydraulic fluid pipes d, e1, f, g, a logic valve 14, and a differential circuit for increasing injection speed. Specifically, the piston 12 is advanced during the injection step so that hydraulic fluid ejected from the piston retraction-side hydraulic chamber 11*b* is supplied to the hydraulic fluid pipe (the work fluid pipe c in this embodiment) between the variable displacement pump 16 and the piston advancement-side hydraulic chamber 11*a*. As a result, the amount of hydraulic fluid supplied to the piston advancement-side hydraulic chamber 11*a* is increased. The increased amount of the hydraulic fluid supplied to the piston advancement-side hydraulic chamber 11*a* increases the moving speed of the piston 12 and hence the injection speed. Incidentally, the hydraulic fluid pipe g includes a restriction mechanism 19 for suppressing the injection speed reduction as described later.

The die unit 20 includes a fixed platen 21*a*, a movable platen 21*b*, a fixed die 22, a movable die 23, a die cavity 24, a gate 25, a molten metal supply port 26 and a plunger rod 27.

The fixed platen 21*a* includes a fixing member 50 for fixing the fixed die 22 on the fixed platen 21*a*. This fixing member 50 includes hooks 50*a* inserted into grooves 22*a* formed on the fixed die 22. On the other hand, the movable platen 21*b*, includes a fixing member 51 for fixing the movable die 23 on the movable platen 21*b*. The fixing member 51 includes hooks 51*a* inserted into grooves 23*a* formed on the movable die 23. By inserting the hooks 50*a* into the grooves 22*a*, the fixed die 22 is fixed to the fixed platen 21*a*. In a similar fashion, by inserting the hooks 51*a* into the grooves 23*a*, the movable die 23 is fixed to the movable platen 21*b*.

Under this condition, the dies are clamped by moving the movable die 23 fixed to the movable platen 21*b* toward the fixed die 22 by, for example, a drive motor (not shown). Thus, the movable die 23 is pressed against the fixed die 22 thereby forming the die cavity 24 and gate 25.

The fixed die 22 and fixed platen 21*a* have a plunger sleeve 41 with a plunger rod 27 movably (slidably) inserted therein. The plunger sleeve 41 is formed with a molten metal supply port 26 for supplying the molten metal. The plunger rod 27, with the piston 12 advanced toward the plunger rod 27, slides in the plunger sleeve 41 toward the fixed die 22 and the movable die 23. The molten metal supplied from the molten metal supply port 26 is filled in the die cavity 24 with the plunger rod 27 sliding toward the fixed die 22 and the movable die 23 in the plunger sleeve 41. Incidentally, with the piston rod 12*b* and the plunger rod 27 connected by the coupling 30, the injection unit 10 and die unit 20 can be driven in operatively interlocked relation to each other.

The operation of the die casting machine 100 according to this embodiment is explained. The process of forming a die-cast product includes the injection step of injecting the molten metal into the die cavity 24, the high pressure holding step for preventing a blowhole from being formed in the die-cast product and the step of retracting the plunger rod 27 and the piston 12.

First, the injection step is explained. The movable platen 21*b* is moved in the die-closing direction thereby clamping the movable die 23 fixed to the movable platen 21*b* and the fixed die 22 fixed to the fixed platen 21*a* and supplies molten metal (not shown) to the molten metal supply port 26. Then, the servo motor 17 is started to activate the variable displacement pump 16. At the same time, the logic valve 14 is opened, i.e. a fifth hydraulic fluid path of the hydraulic fluid paths is formed by connecting hydraulic fluid pipes f and g. At the same time, the logic valve 13 is closed, i.e. hydraulic fluid pipes e2 and h1 are separated from each other thereby interrupting a sixth hydraulic fluid path of the hydraulic fluid paths. The directional control valve 15 forms the first hydraulic fluid path by connecting hydraulic fluid pipes b and c, while at the same time interrupting the second hydraulic fluid path by separating hydraulic fluid pipes i and j from each other.

Upon activation of the variable displacement pump 16, the hydraulic fluid in the hydraulic fluid tank 40 flows into the piston advancement-side hydraulic chamber 11*a* of the injection cylinder 11 through the hydraulic fluid pipe a, the hydraulic fluid pipe b, the directional control valve 15 and the hydraulic fluid pipe c, resulting in the piston 12 being advanced toward the plunger rod 27.

With this advance of the piston 12, hydraulic fluid is discharged from the piston retraction-side hydraulic chamber 11*b*. The hydraulic fluid thus discharged is supplied to the hydraulic fluid pipe c through the hydraulic fluid supply path including hydraulic fluid pipes d, e1, f, logic valve 14 and hydraulic fluid pipe g. In the process, hydraulic fluid pipe e2 is separated from hydraulic fluid pipe h1, and hydraulic fluid pipe j from hydraulic fluid pipe i, by logic valve 13 and directional control valve 15, so that the sixth and second hydraulic fluid paths are interrupted. The hydraulic fluid ejected from the piston retraction-side hydraulic chamber 11*b*, is therefore supplied to hydraulic fluid pipe c.

The discharge amount Q2 from the piston retraction-side hydraulic chamber 11*b* is added to the discharge amount Q1 of the variable displacement pump 16 to constitute the amount Q3 supplied to the piston advancement-side hydraulic chamber 11*a*. According to this embodiment, this differential operation is performed by a differential circuit so that a large volume of hydraulic fluid is supplied to the piston advancement-side hydraulic chamber 11*a*. As a result, the piston 12 is moved forward at high speed, and the plunger rod 27 is pushed out at high speed thereby filling the molten metal in the die cavity 24 at high speed.

If V1 is the drive speed of the piston 12 in the absence of the differential circuit according to the invention, thus the drive speed V of the piston 12 with the differential circuit according to the invention is given by V=V1×S1/S2, where S1 is the inner sectional area of the injection cylinder 11 and S2 the sectional area of the piston rod 12*b*. Assuming that V1 is 0.5 m/s, S1 8000 $mm^2$ and S2 2000 $mm^2$, then the drive speed V of the piston 12 with the differential circuit according to the invention is 2.0 m/s.

In the process of filling the molten metal at high speed in the die cavity 24, the resistance of the molten metal reaches a maximum at the position of the gate 25 where the sectional area is smallest and the injection speed (moving speed of the piston 12) may be reduced. For this reason, a restriction mechanism 19 is preferably included in the hydraulic fluid pipe g.

Specifically, in the absence of the restriction mechanism 19 as shown in FIG. 2A, the pressure of the piston advancement-side hydraulic chamber 11*a* is substantially zero during the high-speed movement of the piston 12 (before point A). In the case where the speed of the plunger rod 27 (piston 12) increases to a predetermined level, as shown by point A, energy is consumed by the increase in pressure to overcome the pressure in the molten metal filling operation, i.e. the resistance of the gate 25, which results in a decrease in speed.

In the presence of the restriction mechanism 19 in the ejected fluid supply path, back pressure is generated in the piston retraction-side hydraulic chamber 11*b*, and therefore, even during high-speed movement of the piston 12, a certain degree of pressure is held in the piston advancement-side hydraulic chamber 11*a*. In the presence of the restriction mechanism 19, as shown by point A in FIG. 2B, only a small amount of energy is required to increase the pressure to overcome the pressure in the molten metal filling operation, i.e. the resistance of the gate 25, which results in minimizing the decrease in speed. The holding pressure in the injection cylinder 11 is desirably not less than 0.5 MPa.

The injection speed increase will be explained. In the absence of the differential circuit, i.e. in the case where the hydraulic fluid ejected from the piston retraction-side hydraulic chamber 11*b* is not supplied to the hydraulic fluid pipe c, the amount of the hydraulic fluid supplied to the piston advancement-side hydraulic chamber 11*a* is equal to the discharge amount Q1 of the variable displacement pump 16. Therefore, the speed of the piston 12, i.e. the injection speed assumes a value corresponding to the output of the servo motor 17 and the capacity of the variable displacement pump 16.

By supplying the hydraulic fluid ejected from the piston retraction-side hydraulic chamber 11*b* again to the hydraulic fluid pipe c in the presence of the differential circuit as described above, the amount of hydraulic fluid supplied to the piston advancement-side hydraulic chamber 11*a* increases beyond the discharge amount Q1 of the variable displacement pump 16 by the discharge amount Q2 from the piston retraction-side hydraulic chamber 11*b*, resulting in Q3=(Q1+Q2). In the case where the output of the servo motor 17 and the capacity of the variable displacement pump 16 are equal to each other, the increased amount of hydraulic fluid supplied to the piston advancement-side hydraulic chamber 11*a* increases the speed of the piston 12, thereby making it possible for high-speed injection. In other words, high-speed injection is possible without using an expensive large-output motor or a large-capacity pump. Incidentally, low-speed injection may be followed by high-speed injection in the injection step.

Next, the high pressure holding step will be explained. The high pressure holding step prevents a blowhole from being formed in the die-cast product, i.e. prevents a blowhole from being formed in the molten metal filled in the die cavity 24.

As shown in FIGS. 2A and 2B, the injection step is completed when the piston 12 reaches a predetermined position B or when the pressure in the piston advancement-side hydraulic chamber 11*a* reaches a predetermined point X. Upon completion of the injection step, the high pressure holding step is executed In the high pressure holding step, high pressure is required, but a large amount of hydraulic fluid is not required. Thus the torque of the servo motor 17 can be applied in its entirety to the piston 12 without the operation of the hydraulic fluid in the differential circuit by opening the logic valve 13 and closing the logic valve 14.

Under this condition, the servo motor 17 is started while at the same time reducing the capacity of the variable displacement pump 16 thereby supplying high-pressure hydraulic fluid In the process, the logic valve 14 is in a closed state, i.e. the fifth hydraulic fluid path is interrupted by hydraulic fluid pipes f and g separated from each other. The logic valve 13, on the other hand, is in an open state, i.e. the hydraulic fluid path is formed by connecting hydraulic fluid pipes e2 and h1. The directional control valve 15 forms the first hydraulic fluid path by connecting hydraulic fluid pipes b and c to each other while at the same time interrupting the second hydraulic fluid path by separating hydraulic fluid pipes i and j from each other.

Once the variable displacement pump 16 is started, the hydraulic fluid in the hydraulic fluid tank 40 flows into the piston advancement-side hydraulic chamber 11*a* of the injection cylinder 11 under high pressure through hydraulic fluid pipe a, hydraulic fluid pipe b, directional control valve 15 and hydraulic fluid pipe c, thereby advancing the piston 12. Further, the hydraulic fluid ejected from the piston retraction-side hydraulic chamber 11*b* is discharged into the hydraulic fluid tank 40 through hydraulic fluid pipes d, e1, e2, h1 and h2. Under this condition, only a small amount of the molten metal is supplied in accordance with the shrinkage volume due to the cooling of the metal filled in the die cavity 24. Therefore, only a small amount of high-pressure hydraulic fluid continues to be supplied to the piston advancement-side hydraulic chamber 11*a*.

This high pressure holding step is followed by the cooling step. Once the cooling step is entered, the gate portion communicating with the die cavity 24 is solidified and closed so that substantially no molten metal is supplied. Upon lapse of a predetermined time under this condition, the metal filled in the die cavity 24 is solidified to such an extent as to end the cooling step, after which the movable platen 21*b* is activated to open the die. Then, the solidified die-cast product is moved by being attached to the movable die 23. Finally, an eject mechanism (not shown) is activated to project an eject pin (not shown), and the solidified die-cast product is ejected and recovered from the movable die 23.

At the end of the high pressure holding step and cooling step, the step is executed to retract the plunger rod 27 and the piston 12. The servo motor 17 is started and the variable displacement pump 16 is activated. In the process, the logic valve 14 is in a closed state, i.e. hydraulic fluid pipes f and g are separated from each other so that the fifth hydraulic fluid path is interrupted. Also, the logic valve 13 is in a closed state, i.e. hydraulic fluid pipes e2 and h1 are separated from each other thereby interrupting the sixth hydraulic fluid path. The directional control valve 15 forms the third hydraulic fluid path by connecting hydraulic fluid pipes b and j, while at the same time forming the fourth hydraulic fluid path by connecting hydraulic fluid pipes c and i.

Once the variable displacement pump 16 is started, the hydraulic fluid in the hydraulic fluid tank 40 flows into the piston advancement-side working chamber 11*b* of the injection cylinder 11 through hydraulic fluid pipe a, hydraulic fluid pipe b, directional control valve 15, hydraulic fluid pipe j and hydraulic fluid pipe d thereby to retracting the piston 12.

In response, hydraulic fluid is discharged from the piston advancement-side hydraulic chamber 11*a* into the hydraulic fluid tank 40 through hydraulic fluid pipe c, directional control valve 15, hydraulic fluid pipe i and hydraulic fluid pipe h2.

While the invention has been described with reference to specific embodiments chosen for purposes of illustration, it should be apparent that numerous modifications could be made thereto by those skilled in the art without departing from the basic concept and the scope of the invention.

The invention claimed is:

1. A die casting machine for filling by injecting molten metal into a die cavity, comprising:

a pump driven by a drive motor for discharging a hydraulic fluid from a hydraulic fluid tank;

a piston for filling by injecting the molten metal in the cavity;

an injection cylinder with the piston movably assembled therein and having the internal space thereof divided into two hydraulic chambers by the piston;

a hydraulic fluid supply path for supplying the hydraulic fluid discharged by the pump into one of the hydraulic chambers of the injection cylinder;

a first logic valve for switching hydraulic fluid paths through which the hydraulic fluid flows, the first logic valve being arranged in a hydraulic fluid path between one of the hydraulic chambers of the injection cylinder and the hydraulic fluid tank, and adapted to be closed during an injection step for injecting molten metal into the die cavity and to be opened during a high pressure holding step for preventing a blowhole from being formed in a die-cast product;

a second logic valve for switching the hydraulic fluid paths through which the hydraulic fluid flows, the second logic valve being arranged in a hydraulic fluid path between the other one of the hydraulic chambers of the injection cylinder and the hydraulic fluid supply path, and adapted to be opened during the injection step to form an ejected fluid supply path for supplying the hydraulic fluid ejected from the other one of the hydraulic chambers of the injection cylinder to the hydraulic fluid supply path and to be closed during the high pressure holding step; and a restriction mechanism arranged in the ejected fluid supply path for generating pressure in the hydraulic fluid, which operates depending on the first and second logic valves, wherein the restriction mechanism counteracts a pressure from the filling of the molten metal cavity in order to minimize a decrease in a speed of the piston.

2. The die casting machine according to claim 1, wherein the pump is a variable displacement pump.

3. The die casting machine according to claim 1, wherein the drive motor is a servo motor.

4. The die casting machine according to claim 1, further comprising:

hydraulic fluid paths including the hydraulic fluid tank, the pump, the injection cylinder, the hydraulic fluid supply path and the ejected fluid supply path;

a directional control valve for switching the hydraulic fluid paths in accordance with the operation of the injection cylinder; and a control unit for controlling the directional control valve, first and second logic valves, pump and drive motor.

5. The die casting machine according to claim 4, wherein the control unit controls a timing of switching the injection of molten metal into the die cavity and a high pressure holding to prevent a blowhole from being formed in the die-cast product after the injection, and wherein the switch timing is controlled based on at least one of a position signal indicating the piston position in the injection cylinder, a pressure signal indicating fluid pressure in the injection cylinder, a torque signal indicating the torque of the drive motor and a pulse signal of the drive motor.

6. A die casting system for filling by injecting molten metal into a die cavity, comprising:

means for discharging a hydraulic fluid from a hydraulic fluid tank;

means for filling by injecting the molten metal in the cavity;

means for supplying the hydraulic fluid discharged into one of two hydraulic chambers disposed in an internal space of an injection cylinder, wherein the means for filling is movably disposed in the injection cylinder;

first means for switching hydraulic fluid paths through which the hydraulic fluid flows, the first means for switching being arranged in a hydraulic fluid path between one of the hydraulic chambers of the injection cylinder and the hydraulic fluid tank, and adapted to be closed during an injection step for injecting molten metal into the die cavity and to be opened during a high pressure holding step for preventing a blowhole from being formed in a die-cast product;

second means for switching the hydraulic fluid paths through which the hydraulic fluid flows, the second means for switching being arranged in a hydraulic fluid path between the other one of the hydraulic chambers of the injection cylinder and the hydraulic fluid supply path, and adapted to be opened during the injection step to form an ejected fluid supply path for supplying the hydraulic fluid ejected from the other one of the hydraulic chambers of the injection cylinder to the hydraulic fluid supply path and to be closed during the high pressure holding step; and means for generating pressure in the hydraulic fluid, arranged in the ejected fluid supply path, which operates depending on the first and second means for switching, wherein the means for generating the pressure counteracts a pressure from the filling of the molten metal cavity in order to minimize a decrease in a speed of the means for filling.

* * * * *